United States Patent [19]

Louison et al.

[11] Patent Number: 4,822,686

[45] Date of Patent: Apr. 18, 1989

[54] IRON BASEPLATE HAVING AN ENAMEL COATING

[75] Inventors: Bernard Louison, Saint Etienne; Henri Piera, Annecy, both of France

[73] Assignee: Seb S. A., Selongey, France

[21] Appl. No.: 123,948

[22] Filed: Nov. 23, 1987

Related U.S. Application Data

[62] Division of Ser. No. 856,168, Apr. 28, 1986, abandoned.

[30] Foreign Application Priority Data

May 2, 1985 [FR] France ..... 85 06684

[51] Int. Cl.[4] ..... B32B 15/04

[52] U.S. Cl. ..... 428/457; 427/419.4; 427/376.2; 38/93; 38/97; 38/142

[58] Field of Search ..... 427/419, 4; 428/457; 38/142, 93, 97

[56] References Cited

U.S. PATENT DOCUMENTS 4,665,637 5/1987 Kramer ..... 38/93

FOREIGN PATENT DOCUMENTS 399574 2/1962 Japan .
46144 11/1979 Japan .

*Primary Examiner*—Edith Buffalow
*Attorney, Agent, or Firm*—Young & Thompson

[57] ABSTRACT

The iron baseplate (1) has an enamel coating (8) on its surface (7) intended to be applied to the articles for ironing.

This enamel coating (8) provides inter alia an improved coefficient of friction between the baseplate and the textile articles for ironing.

Use inter alia in steam irons.

3 Claims, 1 Drawing Sheet

IRON BASEPLATE HAVING AN ENAMEL COATING

This application is a division of application Ser. No. 856,168, filed 4/28/86, now abandoned.

This invention relates to a baseplate for an iron, more particularly a steam iron.

The invention also relates to irons having a baseplate of this kind.

Dry or steam iron baseplates are at the present time made of an aluminium alloy produced inter alia by pressure die-casting.

These aluminium alloys are not very hard, so that the surface of the iron baseplate is easily scratched during the ironing of textile articles with hard objects such as buttons, zip fasteners, clasps, and so on.

These scratches result in baseplate wear, thus increasing the coefficient of friction between the baseplate and the textile articles for ironing, so that ironing becomes increasingly arduous to the user.

Also, with use, these aluminium alloy baseplates become increasingly sensitive to staining due to the oxidation produced inter alia by the steam and carbonized organic materials originating from the textile articles.

These stains soil the textile articles unless the iron baseplate is frequently cleaned.

Of course the presence of scratches on the surface of the iron baseplate promotes the adhesion of these stains and they become very difficult to clean if the baseplate is considerably scratched.

At the present time the following action is taken to limit the formation of scratches on iron baseplates:

(a) the irons are supplied to the user with a provisional protection which protects the baseplate from mechanical impacts during handling and transport; this step affects the cost price of the iron.

(b) The baseplates are made from an aluminium alloy which contains magnesium, which is harder but more complicated than the more conventional aluminium alloys which contain silicon.

(c) The baseplate surface is carefully polished to reduce its coefficient of friction as much as possible with respect to the articles for ironing; this operation is also expensive.

The object of this invention is to obviate all the above disadvantages.

According to the invention, the baseplate for an iron, more particularly a steam iron, is characterised in that at least its surface which is intended to be applied to the articles for ironing is covered with an enamel coating.

The enamel coating greatly increases the hardness of the baseplate so that it has a remarkably good resistance to abrasion produced by the metal parts of textile articles.

The metal coating also effectively protects the baseplate from oxidation produced by the steam and other chemical products.

Also, the stains caused by the scale produced as a result of the evaporation of the water or by the carbonization of the organic materials originating from the ironed articles cannot take hold on the enamel coating, so that the baseplate is easily cleanable.

It has also been found that the enamel coating provides a substantial reduction in the coefficient of friction between the baseplate and the articles for ironing, so that users can iron without effort. This property is surprising in view of the fact that it does not result from the known properties of enamel coatings. That is incidentally one reason why enamel coatings have never been used to improve the coefficient of friction. Also, this enamel coating withstands mechanical impacts so that no provisional protection is required. It also enables cheaper alloys to be used for the baseplate and for the expensive polishing of the baseplate to be replaced by a simple mechanical abrasion by means of an abrasive cloth.

The enamel coating thus not only enables the life of the iron to be lengthened and to facilitate its use and cleaning, but also allows the cost of the iron to be reduced.

The baseplate may be made from an aluminium alloy, for example by pressure diecasting, vacuum casting or gravity diecasting, and containing silicon. This type of aluminium alloy is cheap but relatively soft. The enamel coating however gives the baseplate surface ample hardness.

These cast aluminium alloys have the feature that there are air micro-bubbles within the alloy. In conventional baseplates which are not coated with enamel the presence of these air micro-bubbles is not harmful.

However, it has been found experimentally that if a conventional aluminium enamel frittable at a temperature of about 600° C. is applied to these baseplates, there is a relatively high reject rate, although the enamel coating has good adhesion, and applicants would give the following reason for this: when the baseplate is heated to a temperature above 350° C., the said air micro-bubbles escape from the alloy. From 500° C. onwards this phenomenon is sufficient to blister the enamel coating. Also, baseplate deformation is found above that temperature.

According to an important feature of this invention, the said disadvantage is obviated by making the enamel coating from an enamel frit which is frittable at a temperature below 500° C. Applicants have also found that the emissivity of a polished aluminium baseplate is of the order of 0.1, while that of an enamel coating is about 0.8. Thus in the case of an aluminium baseplate coated with enamel a more favourable transfer is obtained, corresponding to 40 Watts, when the baseplate is at 225° C. in the case of dry ironing, the consumption being of the order of 630 Watts during this ironing. The temperature drop caused by the enamel coating is about 3° C., which is negligible. It may therefore be considered that the ironing performance with an enamelled baseplate is 40/630, i.e. 6%, better than that of a polished aluminium baseplate not coated with enamel. This result is surprising in view of the fact that enamel is a thermal insulator so that a reduction in ironing performance might have been expected.

Other features and advantages of the invention will be apparent from the following description.

In the accompanying drawings, which are given by way of example without limiting force:

Figure 1:
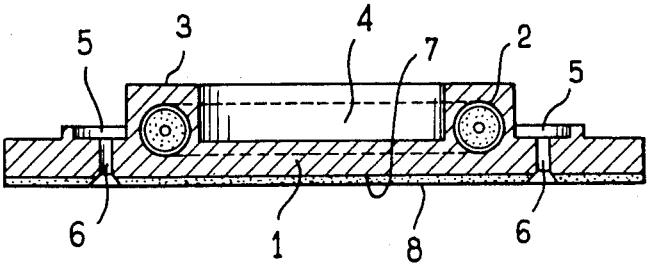
FIG. 1 is a cross-section of an iron baseplate having an enamel coating.

In the embodiment shown in FIG. 1, the iron baseplate is made from an aluminium alloy by pressure diecasting, vacuum casting or gravity diecasting, such as $AS_9U_3$, $AS_9G$, $AU_4G$, $AS_{12}$ or $AG_5$ (A denotes aluminium, S silicon, U copper and G magnesium). A screened tubular heating resistance 2 is embedded in the aluminium alloy of the baseplate 1 by the same being cast around it.

The projection 3 surrounding the resistance 2 defines an inner evaporation chamber 4 and a peripheral steam distribution chamber 5. These two chambers 4, 5 are intended to be covered by a sealing cap (not shown). The peripheral steam distribution chamber 5 leads to the exterior via steam distribution ducts 6 extending through the baseplate 1.

According to the invention, the surface 7 of the baseplate 1 which is intended to be applied to the articles for ironing is covered by an enamel coating 8.

Enamel coating 8 is made by spraying on to the baseplate surface 7 an enamel frit slip which is then dried, and then fired, to vitrify the mineral particles ($SiO_2$ and other metallic oxides) contained in this slip.

To prevent blistering and deformation of the baseplate as indicated hereinbefore, due to liberation of the air from the air micro-bubbles imprisoned in the aluminium alloy, an enamel frit is used which is frittable at a temperature below 500° C., e.g. the frit marketed by Messrs. FERRO under the name GL 43-48, which frits at 480°–490° C. The thickness of the enamel coating 8 is generally between 20 and 100 microns.

Excellent keying for the enamel coating 8 is obtained by subjecting the baseplate surface 7 to mechanical or chemical abrasion to form micro-roughnesses or micro-cavities on this surface. It is also advantageous to apply to the baseplate surface 7 a keying undercoat formed, for example, by chromatation.

The enamel coating 8 may also partly or completely cover the inner surface of the steam distribution ducts 6 so as to limit adhesion of the scale or tartar formed by evaporation of the water and likely to clog these ducts.

Figure 2:
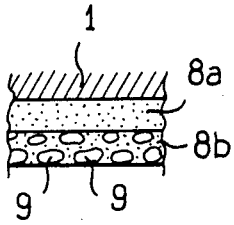
FIG. 2 is an enlarged-scale partial section of an enamel coating consisting of two layers.

The enamel coating may be formed by two layers of enamel 8*a*, 8*b* (see FIG. 2) simultaneously fired in accordance with the method described in applicants' French patent application No. 83 06178 of 15 Apr. 1983, the enamel frit described in that patent application being replaced by the above-mentioned which frits at 480°–490° C.

At least the outer layer 8*b* may contain coloured pigments 9 (see FIG. 2) or may be applied by screen-printing if a pattern or decoration is to be formed on the surface of the baseplate 1.

It has also been found that the enamel coating 8, in view of its thinness, has no adverse effect on the thermal conductivity of the baseplate. There is therefore no need to provide the enamel coating with conductive particles.

To obviate the difficulties due to the micro-bubble phenomenon referred to hereinbefore, a rolled aluminium alloy sheet may be used to form the baseplate.

Figure 3:
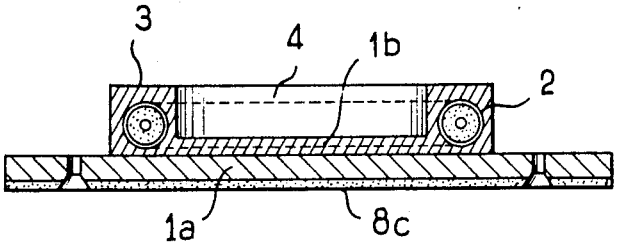
FIG. 3 is a similar view to FIG. 1 relating to a variant embodiment.
Figure 4:
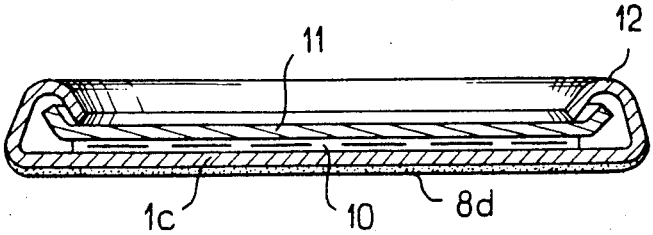
FIG. 4 is a similar view to FIG. 1 relating to another variant embodiment.

FIGS. 3 and 4 relate to two examples of an iron baseplate using a rolled aluminium alloy sheet.

In the embodiment shown in FIG. 3, the rolled alloy sheet 1*a* is connected to a top part 1*b* made by diecasting as in the embodiment shown in FIG. 1. This connection may, for example, be made by hot stamping.

The enamel coating 8*c* applied to the surface of the aluminium alloy sheet 1*a* may be produced from a conventional enamel composition for aluminium frittable at a temperature between 500° and 600° C. Of course the assembly should be able to withstand this temperature.

In the embodiment shown in FIG. 4, the base plate also comprises an aluminium alloy sheet 1*c* with an enamel coating 8*d*. A flat resistance 10 enclosed in an insulating material is applied to the opposite surface of the sheet 1*c* to that having the enamel coating 8*d*. The flat resistance 10 is pressed against the sheet 1*c* by a back plate 11 by crimping 12 along the edges of the sheet 1*c*.

Of course the invention is not limited to the above examples and numerous modifications may be made to these without departing from the scope of the invention.

For example, the invention also applies to iron baeplates made from cast iron.

Also the enamel coating 8, 8*a*, 8*b*, 8*c* could be applied to the side surfaces of the baseplate as well.

Also, the enamel coating could also cover the interior of the evaporation and steam distribution chambers 4 and 5. In that case the tartar or scale deposit in these chambers would have reduced adhesion and could therefore be removed more easily than from conventional baseplates.

We claim:

1. A baseplate for an iron, comprising a first part (3) made from a cast aluminum alloy in which is embedded a tubular heating resistance (2), and a second part (1*a*) made from a rolled aluminum alloy sheet which is secured directly to a surface of said first part (3), the external face of said rolled sheet being covered with an enamel coating produced from an enamel frit composition frittable at a temperature comprised between 500° to 600° C.

2. A baseplate for an iron as claimed in claim 1, in which the surface of the aluminum sheet to which the enamel is applied is roughened.

3. A baseplate for an iron as claimed in claim 1, there being a keying undercoat for the enamel coating which is made by chromatation.

* * * * *